US006129524A

United States Patent [19]

Woollenweber et al.

[11] Patent Number: 6,129,524

[45] Date of Patent: Oct. 10, 2000

[54] MOTOR-DRIVEN CENTRIFUGAL AIR COMPRESSOR WITH AXIAL AIRFLOW

[75] Inventors: William E. Woollenweber, Carlsbad; Edward M. Halimi, Montecito, both of Calif.

[73] Assignee: Turbodyne Systems, Inc., Carpeinteria, Calif.

[21] Appl. No.: 09/206,918

[22] Filed: Dec. 7, 1998

[51] Int. Cl.[7] ..... F04B 17/00; F04B 35/00

[52] U.S. Cl. ..... 417/366; 417/371

[58] Field of Search ..... 417/244, 357, 417/247, 369, 371, 366; 60/602; 415/199.1; 416/244 A; 310/62, 87, 216

[56] References Cited

U.S. PATENT DOCUMENTS

| | | | |
|---|---|---|---|
| 3,941,506 | 3/1976 | Robb et al. | 416/244 A |
| 4,339,922 | 7/1982 | Navarro | 60/602 |
| 4,523,896 | 6/1985 | Lhenry et al. | 417/244 |
| 4,616,980 | 10/1986 | Carpenter | 417/357 |
| 4,684,329 | 8/1987 | Hashimoto | 417/357 |
| 4,883,982 | 11/1989 | Forbes et al. | 310/62 |
| 4,969,803 | 11/1990 | Turanskyj | 417/247 |
| 5,062,766 | 11/1991 | Miura et al. | 415/199.1 |
| 5,397,220 | 3/1995 | Akihisa et al. | 417/369 |
| 5,627,420 | 5/1997 | Rinker et al. | 310/87 |
| 5,904,471 | 5/1999 | Woolenweber et al. | 417/371 |
| 5,949,171 | 9/1999 | Horski et al. | 310/216 |
| 5,997,261 | 12/1999 | Kershaw et al. | 417/366 |
| 6,012,909 | 1/2000 | Sloteman et al. | 417/366 |

*Primary Examiner*—Teresa Walberg
*Assistant Examiner*—J. Fastovsky
*Attorney, Agent, or Firm*—Brinks Hofer Gilson & Lione

[57] ABSTRACT

A motor-driven compressor-electronic motor power package assembly places temperature-sensitive components of the electric motor or the electronic power package for the electric motor, or both, in heat transfer relationship with the flow of compressed air from the compressor.

32 Claims, 7 Drawing Sheets

MOTOR-DRIVEN CENTRIFUGAL AIR COMPRESSOR WITH AXIAL AIRFLOW

FIELD OR THE INVENTION

This invention relates generally to motor-driven air compressors for supplying compressed air in various industrial processes, such as pneumatic conveying of dry bulk materials, and particularly to motor-driven compressor-electronic package assemblies for supplying charge air to the cylinders of internal combustion engines.

BACKGROUND OF THE INVENTION

The brushless permanent magnet electric motors preferably used to drive compressors comprise a rotor with a plurality of permanent magnets mounted to a rotatable shaft that is driven by a stator comprising a plurality of windings adjacent, and preferably surrounding, the permanent magnets. The electric motor is powered through an electronic controller that generates polyphase alternating current for application to the stator winding and the creation of a rotating magnetic field that interacts with and rotates the permanent magnets and motor shaft. The components of the electronic controller include temperature sensitive semiconductor devices, such as MOSFETS, to convert direct current power into the polyphase alternating current necessary for operation of the permanent magnet motors, as disclosed, for example, in U.S. patent application Ser. No. 08/782,566 filed Jan. 10, 1997, now U.S. Pat. No. 5,841,649. Though efficient, such semi conductor devices generate significant heat loss in their operation, particularly when called upon to control the application of high currents to the motor stator windings.

Motor-driven compressors currently in use in commercial internal combustion engines, shown in FIG. 1, usually consist of such brushless electric motors mounted in an aluminum housing and driving a centrifugal air compressor wheel within an enclosing compressor casing. Such motor-driven compressors are frequently installed within the engine compartment of a vehicle, as shown in FIG. 2, where the surrounding environment is at a substantially elevated temperature. In the operation of such air compressors, their motors are energized from a power source such as a battery through an electronic controller, which, as described above, changes direct current from the battery to polyphase alternating current to produce a rotating magnetic field in the motor windings. The rotating field interacts with motor magnets mounted on the drive shaft and generates torque that rotates the compressor wheel and shaft assembly. The compressor wheel induces air from the atmosphere, generally through an air cleaner, into the compressor air inlet and delivers it from the compressor casing at above-atmospheric pressure.

In many applications, such as supercharging systems for internal combustion engines, small size is an advantage. Smaller compressors, however, require higher motor operating speeds to provide sufficient compressed air. Because, among other things, the compressor motor losses are concentrated in, and must be dissipated from, the smaller compressor housing, the compressor motor becomes more temperature sensitive. By "temperature sensitive," we mean a motor or electronic component whose reliability may be at risk, or whose performance may be degraded by the inability to dissipate heat generated during its operation. Motor-driven compressor systems have been improved by bleeding a small portion of the compressed air from the compressor to flow through the motor housing as cooling air for the motor windings, as disclosed in U.S. patent application Ser. No. 08/926,881 filed Sep. 10, 1997.

As set forth above, electronic controllers for high-speed compressor motors include temperature sensitive components, and must be cooled accordingly. Controller housings are typically cooled with a multiplicity of external notches or fins that transfer heat generated by the electronics to the atmosphere. In internal combustion engine applications, compressor motor electronic controllers are also frequently placed at a location remote from the compressor motor to avoid exposure to elevated environmental temperatures (see FIG. 2).

Low-speed compressor motors have employed internal fans attached to their shafts to produce a flow of cooling air through the motor and around its internal components to reduce their temperatures. However, with very highspeed brushless motors, the use of small internal fans imposes significant and undesirable loads on the electric motor, and complicates the internal construction of the compressor housing assembly.

Consequently, compromises in the selection and use of electric motors have been required because of hostile motor environments and the relative inefficiencies of small motors. In addition, the temperatures generated in their electronic controllers have frequently limited the amount of compressed air that can be reliably produced on a continuous basis by current motor-driven compressors.

SUMMARY OF THE INVENTION

This invention provides a motor-driven compressor-electronic controller assembly wherein temperature sensitive electronic controller components may be incorporated into the compressor housing and compressed air may be directed through the compressor housing as cooling air for both the motor windings and electronic controller components. In the invention, the compressor housing and compressed air from the compressor are combined so that internal heat generated in the motor windings and in the electronic controller components is carried away, permitting a higher level of power to be produced reliably by the motor on a continuous basis and, in turn, allowing the compressor to deliver more compressed air at higher pressure to a receiving entity.

A motor-driven compressor of the invention comprises an external housing, a motor that is carried by the external housing, a compressor wheel within the external housing that is driven by the motor, and an electronic power package contiguous with the outside of the external housing, wherein the external housing directs a flow of compressed air from the compressor into heat transfer relationship with the electronic power package and motor parts.

In the invention, the temperature sensitive components of an electronic controller for a compressor motor can be included in an electronic motor power package incorporated into the compressor assembly downstream of the compressor so that the flow of compressed air from the compressor can be used to extract and carry away heat from the temperature sensitive components of the electronic package. In the invention, the external housing of the motor-driven compressor-electronic package assembly can be formed to provide heat sinks to which the temperature sensitive semiconductor components can be directly attached or can be formed to provide a heat transfer mounting surface for a pre-assembled electronic package. Furthermore, an enclosure can be provided over the electronic power package carried by the external housing and can be provided with a flow of compressed air for cooling the temperature-sensitive components of the electronic power package. In addition, the elements of the electric motor, particularly the stator windings, are carried, in the invention, by a motor housing exposed to the cooling effect of the flow of compressed air from the compressor.

In preferred embodiments of the invention, components of both the electric motor and the electronic motor power package can be placed in heat transfer relationship with the flow of compressed air from the compressor. "Heat transfer relationship," as used herein, means that relationship where heat is effectively transferred, or carried away from, a component of either the electric motor or the electronic motor power package by conduction, or by forced convection to the flow of air, or by both conduction and convection, to significantly reduce the temperature rise of the component.

This invention also provides a motor-driven dual compressor assembly with an external housing with three portions, the first and third portions cooperating with compressor wheels at the opposite ends of a shaft that is driven by an electric motor carried within the central second portion. In the assembly, the central second portion forms an air ducting system through which compressed air is directed from the first compressor as cooling air for the motor windings before being directed into the inlet of the second compressor housing for further compression. In such motor-driven dual compressor assemblies, an electronic power package for the motor can be carried by the second housing portion in heat transfer relationship with the air ducting system, and the assembly can be further provided with an enclosure over the electronic power package forming a further compressed air ducting system over the electronic power package for its cooling.

Other features and advantages of the invention will be apparent from the drawings and more detailed description of the invention that follows.

DETAILED DESCRIPTION OF THE BEST MODE OF THE INVENTION

Figure 1:
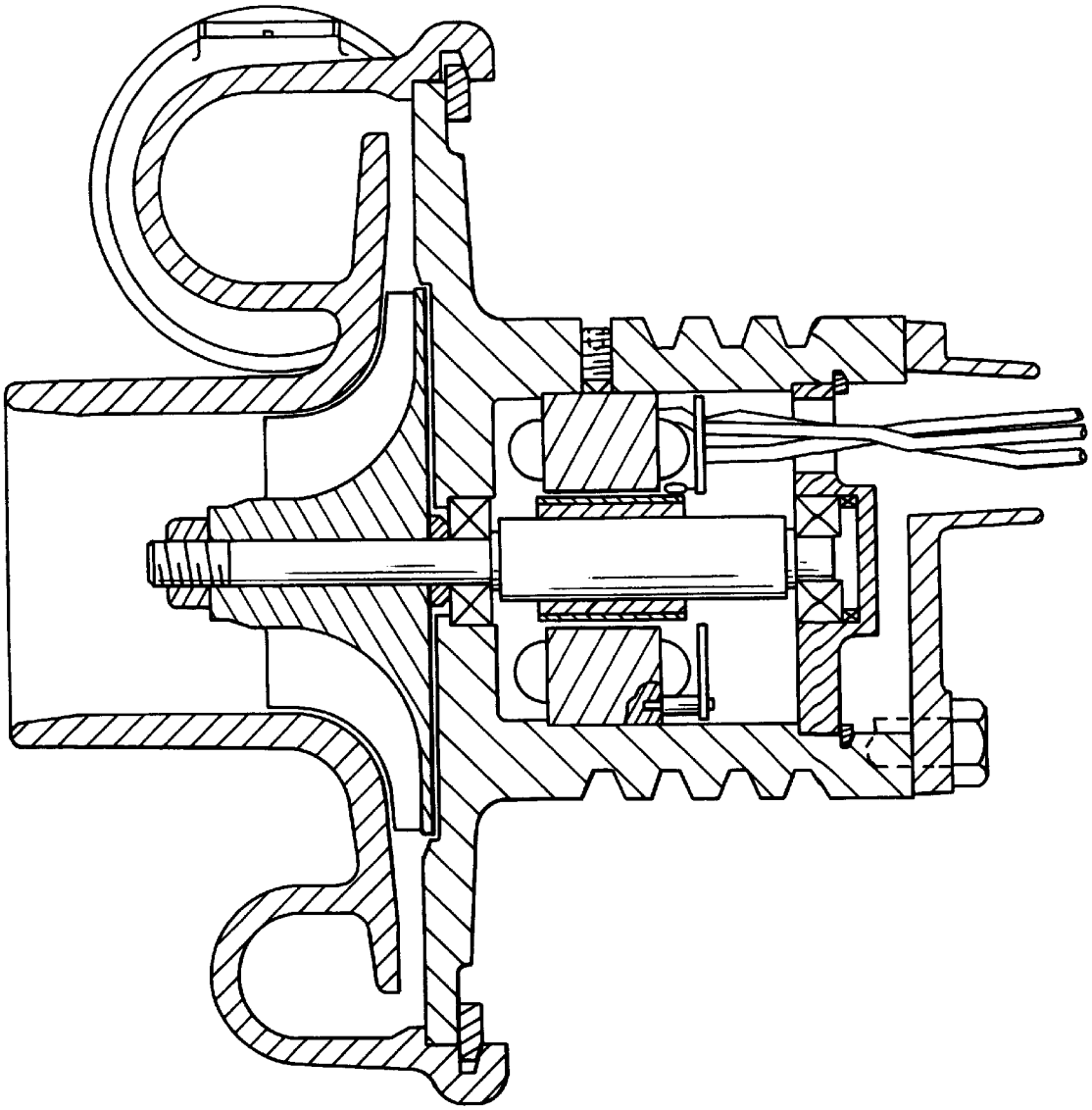
PRIOR ART Fig. 1
FIG. 1 is a cross-sectional view of a prior art motor-driven centrifugal compressor, taken at a plane through its central axis.
Figure 2:
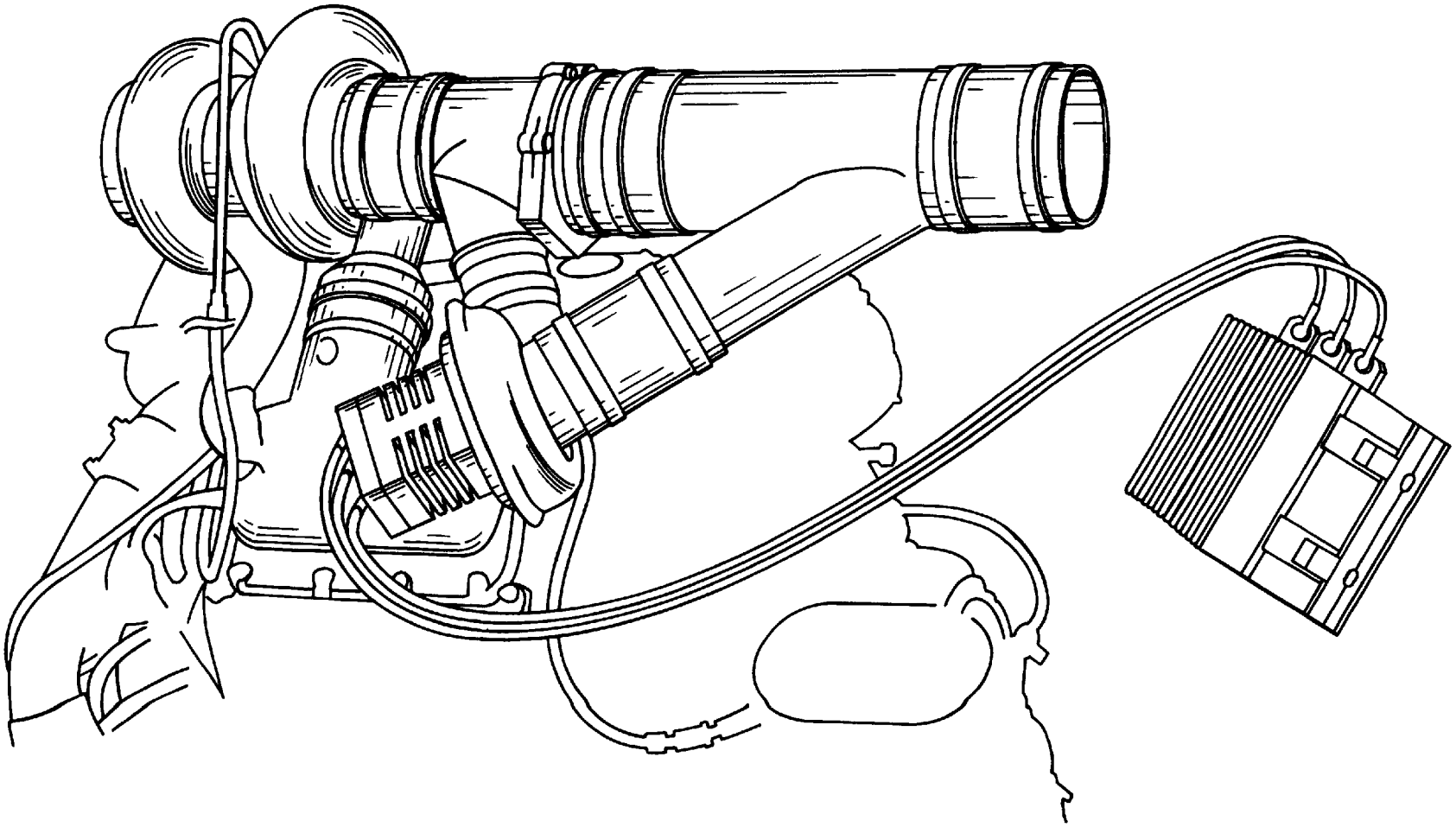
FIG. 2 is an external view of a prior art motor-driven centrifugal compressor and an internal combustion engine, showing a typical arrangement for the compressor and electronic controller assembly.

In the invention, the temperature sensitive components of the electronic controller can be included in an electronic motor power package incorporated into the compressor assembly downstream of the compressor so that the flow of compressed air from the compressor can be used to extract and carry away heat from the temperature sensitive components of the electronic package. In addition, the elements of the electric motor, particularly the stator windings, are carried by a motor housing exposed to the cooling effect of the flow of compressed air from the compressor.

FIGS. 3–6 illustrate various preferred embodiments of the invention. In each of the illustrated embodiments, the external housing (e.g. 20, 65) of the assembly includes a portion directing the flow of compressed air from the compressor into heat transfer relationship with the electric motor, or electronic package components, or both. In this heat transfer relationship, heat to which components of the electronic package and/or the electric motor could be exposed is conducted from and transferred by forced convection to the flow of compressed air.

In the invention, the external housing of the motor-driven compressor-electronic motor power package includes a plurality of portions directing compressed air from the periphery of the compressor wheel so its flow extracts the heat losses of components of the electronic motor power package and the electric motor. In a preferred embodiment of the invention, such as in FIG. 3, the external housing forms an outwardly extending annular compressed air passageway 31, an inwardly extending compressed air passageway 33 with a plurality of flow straightening vanes 38 in heat transfer relationship with the electronic power package 22, and a plurality of axially extending compressed air passageways 35 formed by a plurality of cooling fins 36 in heat transfer relationship with both the electronic power package 22 and electric motor 12. The latter two passageway portions are preferably provided with means 36, 38 for straightening the compressed air flow and enhancing its heat transfer relationship with the electronic power package 22 and electric motor 12.

Figure 4:
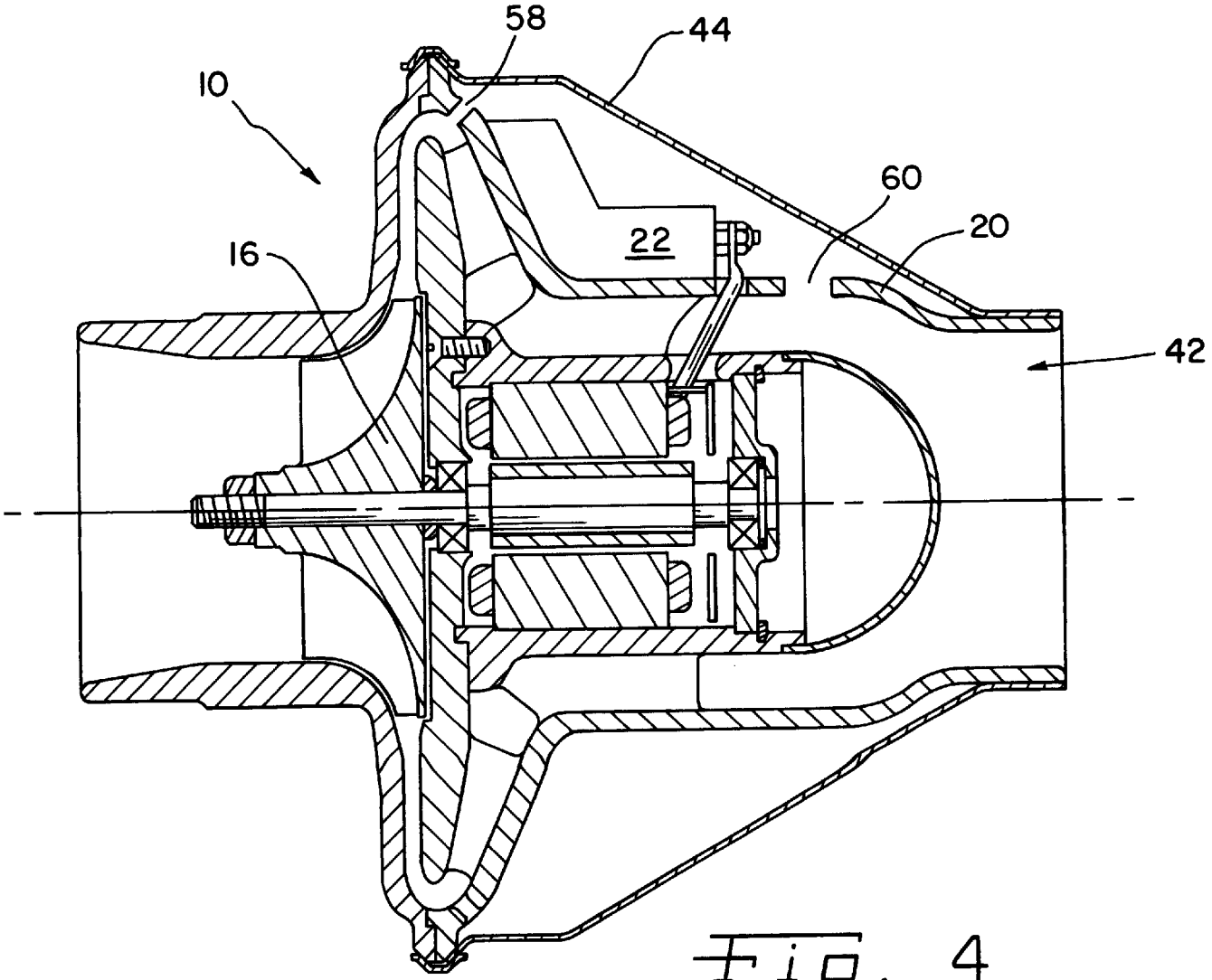
FIG. 4 is a cross-sectional view of another motor-driven compressor-electronic motor power package of this invention, taken at a plane through its central axis, showing a means for providing a further cooling flow of compressed air for the electronic motor power package.
Figure 5:
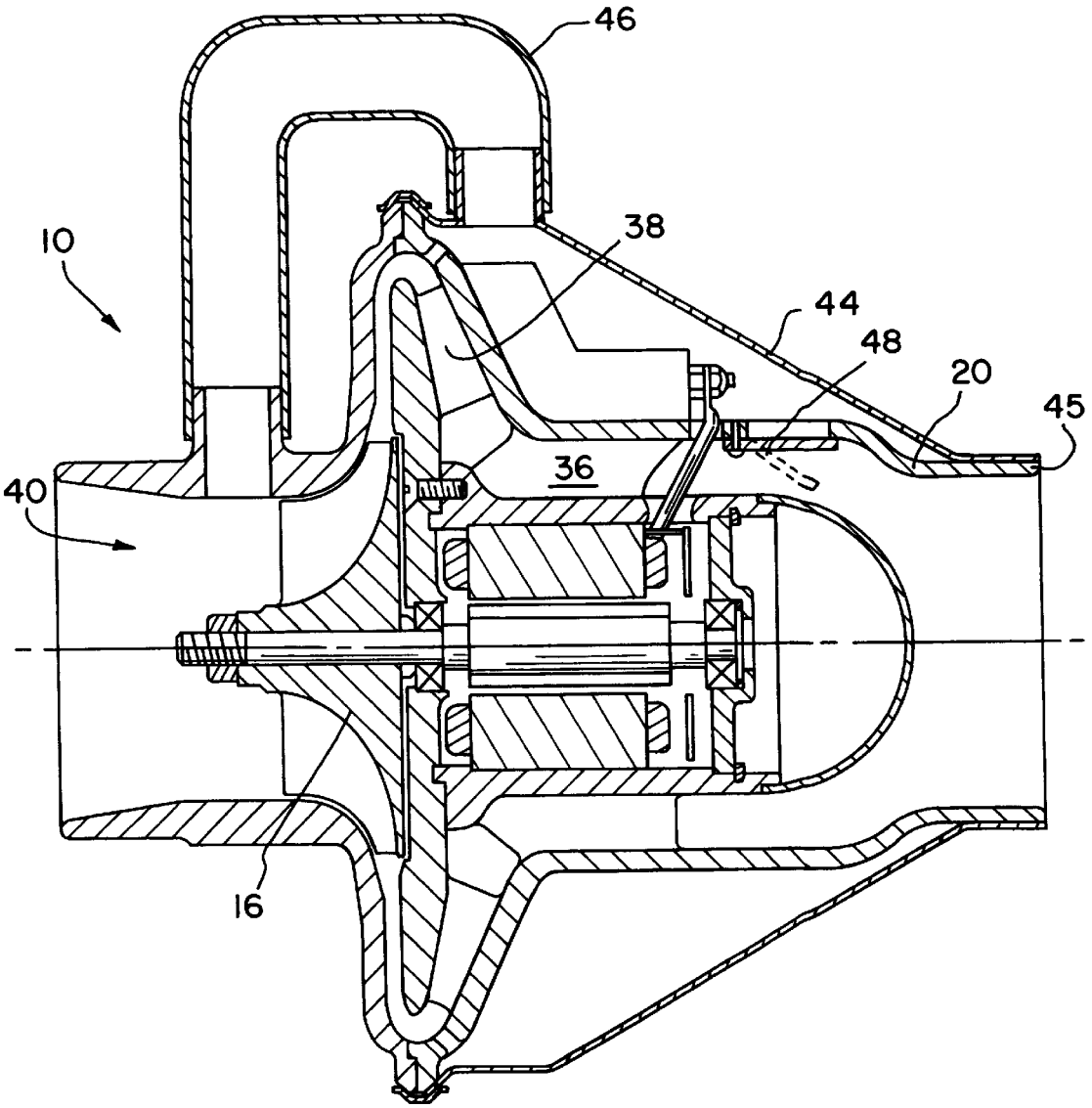
FIG. 5 is a cross-sectional view of a further motor-driven centrifugal compressor of this invention, taken at a plane through its central axis, showing a bypass means for the motor-driven compressor-electronic motor power package.
Figure 6:
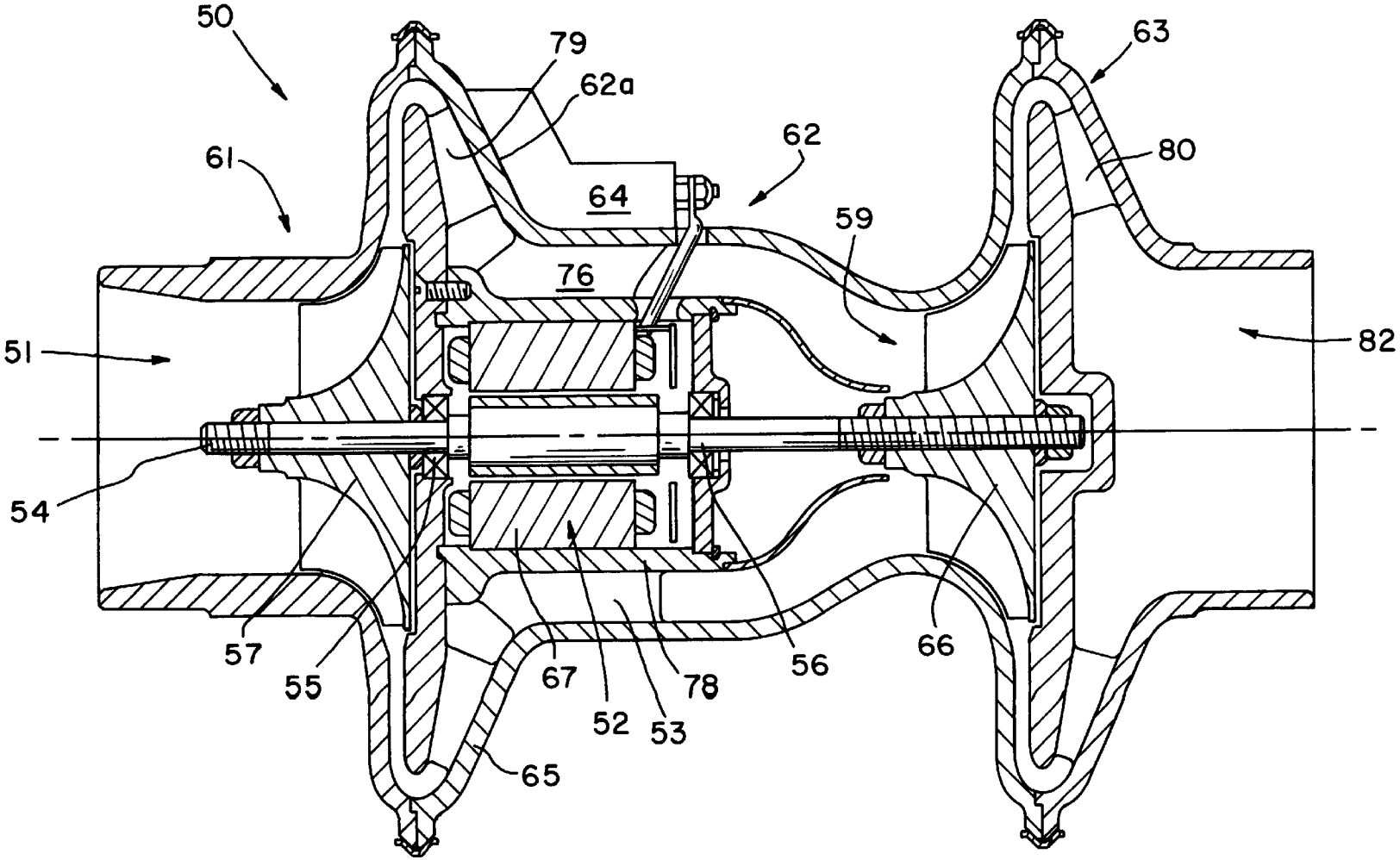
FIG. 6 is a cross-sectional view of a motor-driven compressor-electronic motor power package of the invention with dual compressor wheels, taken through its central axis.

In a further embodiment of the invention, such as in FIG. 4, an enclosure 44 for the electronic power package 22 is provided on the external housing 20, and the external housing 20 is provided with a plurality of openings 58, 60 to direct a further cooling flow of compressed air from the compressor through the enclosure 44 and over the electronic power package 22. Where the compressor is installed in a system where it may restrict system flow, the motor-driven compressor electronic power package assembly may be provided, as shown in FIG. 5, with an air bypass duct 46 between compressor inlet 40 and the enclosure 44 and/or external housing 20. FIG. 6 shows a still further dual compressor embodiment 50 of the invention. The various illustrated preferred embodiments of the invention are described in greater detail below.

Figure 3:
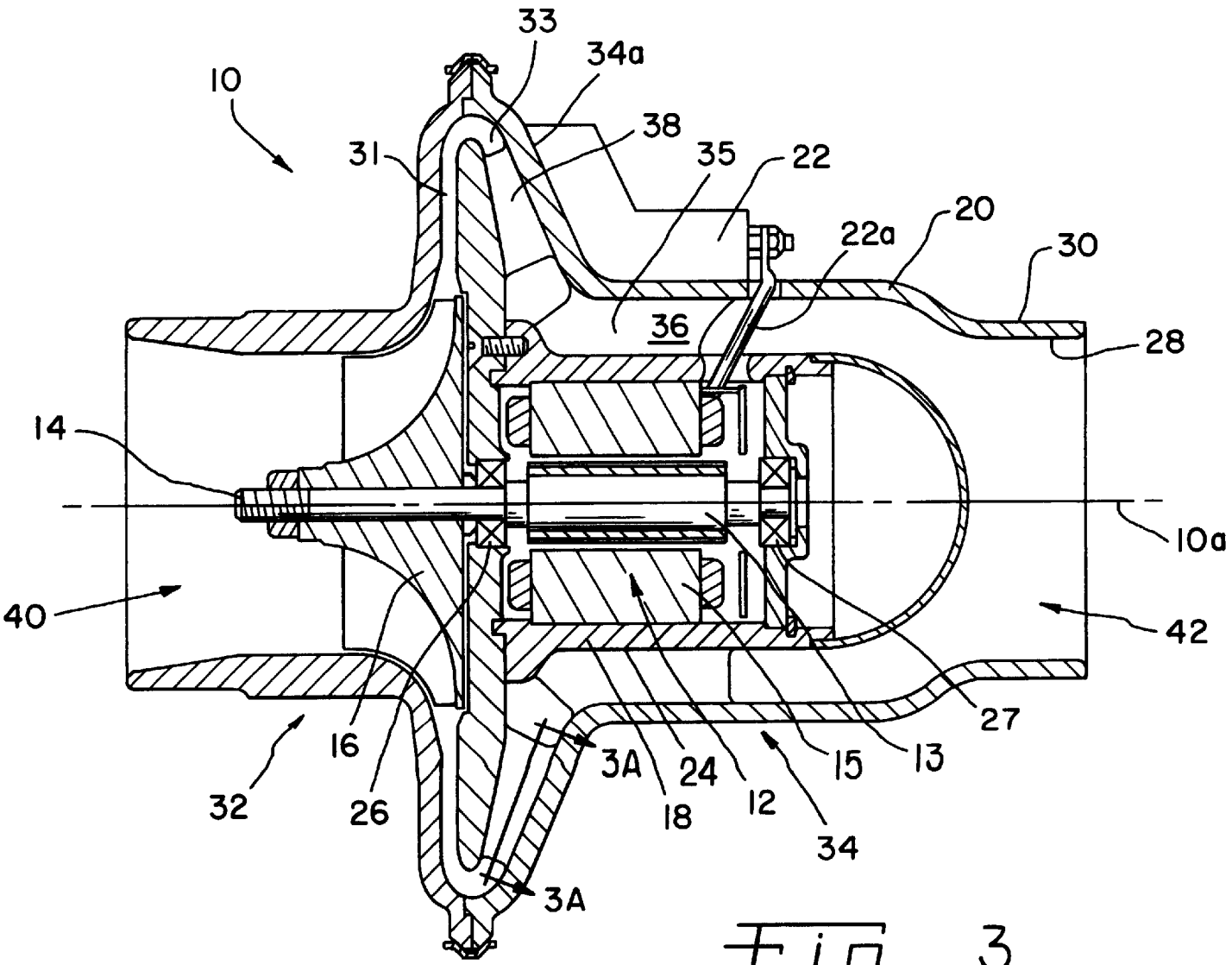
FIG. 3 is a cross-sectional view of a preferred embodiment of a motor-driven compressor-electronic motor power package of this invention, taken at a plane through its central axis.
Figure 3A:
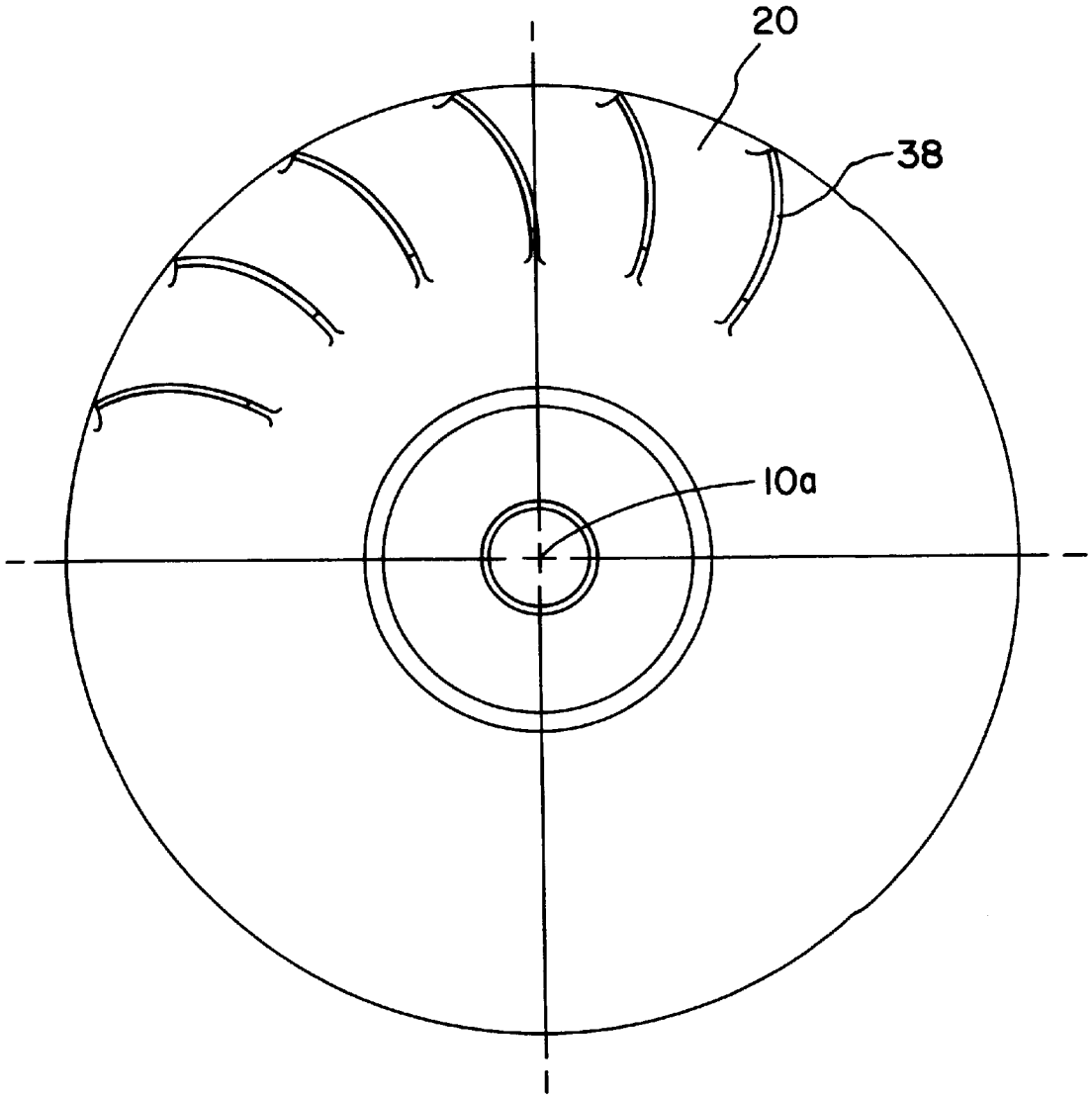
FIG. 3A is a partial cross-sectional view of FIG. 3, taken at a plane corresponding to line 3A—3A of FIG. 3 illustrating flow straightening vanes.

As shown in FIG. 3, a motor-driven compressor-electronic package assembly 10 comprises an electric motor 12 with a permanent magnet rotor 13 and a rotating shaft 14 driven thereby on the central axis 10*a* of the assembly, a centrifugal compressor wheel 16 driven by the rotating shaft 14, a central motor housing 18 which carries the motor stator windings 15, an external housing 20, and an electronic motor power package 22 connected with the electric motor stator windings 15 by connection 22*a*. The central motor housing 18 includes an outside wall 24, and houses the electric motor 12 and rotating shaft 14 while carrying bearings 26, 27 for the rotating shaft 14. The external housing 20 has an inside wall 28 and an outside wall 30, and comprises a first portion 32 forming compressor inlet 40 and cooperating with the compressor wheel 16 to provide a flow of compressed air from the compressor wheel periphery, and a second portion 34 carrying the central motor housing 18, a plurality of cooling fins 36, and a plurality of straightening vanes 38. The straightening vanes 38 (shown in FIG. 3A) alter the flow of air in the second portion 34 of the external housing 20 from a generally tangential flow to a generally axial flow, and the cooling fins 36 and straightening vanes 38 collectively transfer heat from the external housing 20 and the central motor housing 18 to the flow of compressed air through the air ducting system formed by the second external housing portion 34.

In the invention, temperature sensitive components of the electronic controller, such as electronic motor power package 22, are contiguously secured to the outside wall 30 of the external housing 20 in heat transfer relationship with the compressed air flowing therethrough. For example, external housing 20 and electronic motor power package 22 can be manufactured from heat-conducting material, preferably aluminum, so that heat from the components of electronic motor power package 22 is transferred through the external housing 20 and thereafter to the flow of compressed air via the passageway walls, cooling fins 36 and straightening vanes 38, which extend in generally radial directions between the central motor housing 18 and the external housing 20. Preferably, the cooling fins 36 and straightening vanes 38 are formed integrally with the external housing 20 and central motor housing 18 from a heat-conducting material such as aluminum. For example, the second external housing portion 34, central motor housing 18, and cooling fins 36, 38 may be cast in one piece from a suitable aluminum alloy.

The motor-driven compressor-electronic power package assembly 10 works in the following manner. Air entering compressor inlet 40 is radially forced by the rapidly spinning compressor wheel 16 to the periphery of compressor wheel 16, and into outwardly extending passageway 31, to be directed thereafter by the second external housing portion 34 in a generally radially inward direction through a plurality of curved straightening vanes 38. The straightening vanes 38 alter the flow of compressed air from a generally tangential flow to a generally axial flow while conducting and transferring heat from the part of the second external housing portion 34 that carries the electronic motor power package 22 to the flowing compressed air. The second external housing portion 34, motor housing 18, and cooling fins 36 also conduct and transfer heat from the stator windings 15 of the electric motor 12 and from components of electronic motor power package 22 to the flowing compressed air. The compressed air then exits the motor-driven compressor 10 at compressor outlet 42.

As shown in FIG. 4, the assembly 10 of FIG. 3 can further comprise an enclosure 44 for the electronic motor power package 22 and means 58, 60 for bleeding a flow of compressed cooling air from the periphery of compressor wheel 16 through enclosure 44 for cooling the electronic power package 22 housed within. The means includes a first passageway, or compressed air inlet 58, in the external housing 20 adjacent the periphery of compressor wheel 16 and within the enclosure 44, and a second passageway or compressed air outlet 60 through external housing 20 adjacent compressor outlet 42. The enclosure 44, external housing 20, and means 58, 60 form a further air ducting system to provide a cooling flow of compressed air for the components of the electronic motor power package 22.

FIG. 5 shows another embodiment of the invention, wherein the compressor 10 of FIG. 4 further comprises a controlled ducting means for allowing an air bypass in special conditions wherein the flow passages of the compressor 10 may provide a restriction causing an unacceptable pressure drop. In this embodiment, bypass line 46 is connected at one end to compressor inlet 40 and at its second end to enclosure 44 (or if desired, to the compressed air outlet portion 45 of the external housing). Furthermore, control valve 48 controls the exiting flow of air from enclosure 44. This embodiment allows air to bypass compressor wheel 16, straightening vanes 38, and cooling fins 36 in order to supply air in the special operating conditions where a greater quantity of airflow needed downstream of the assembly 10 might otherwise be unduly impeded by assembly 10. Once the pressure of the air flowing from the compressor assembly 10 becomes higher than the downstream pressure, control valve 48 closes the controlled ducting means, preventing the flow of air through bypass line 46.

An additional embodiment of the invention is shown in FIG. 6, wherein a two-compressor assembly 50 is provided for generating higher levels of compressed air, as may be required by various types of supercharging systems or industrial compressed air equipment. As shown in FIG. 6, a two-compressor assembly includes an electric motor 52, a rotating shaft 54 carried by a pair of shaft bearings 55, 56, and two centrifugal compressor wheels 57, 66 attached at opposite ends of shaft 54. The two compressor assembly 50 includes an external housing 65 including a first portion 61 that cooperates with the first compressor wheel 57 to provide to provide a flow of compressed air at its periphery, a second portion 62 that carries electric motor 52 and forms a compressed air ducting system 53, and a third portion 63 that cooperates with the second compressor wheel 66 and further compresses the compressed air delivered by the air ducting system 53 of the second housing portion 62 from the first compressor wheel 57. The second external housing portion 62 and air ducting system 53 transfer heat generated by operation of electric motor 52 to the compressed air flowing axially through the assembly.

The first compressor 57, the first and second housing portions 61 and 62, and electronic power package 64 operate substantially as described above with respect to FIG. 3; however, the presence of the second compressor 66 increases the load on electric motor 52 and electric power package 64.

In a two-compressor system 50, air entering compressor inlet 51 is received by rotating compressor wheel 57 and forced radially to the periphery of compressor wheel 57, to be directed thereafter by the second external housing portion 62 in a generally radially inward direction through a plurality of straightening vanes 79. Straightening vanes 79 alter the flow of compressed air from generally tangential directions to a generally axial direction while transferring heat to the flow of compressed air from, primarily, the second external housing portion 62. A plurality of cooling fins 76 also extend radially between central motor housing 78 and second external housing portion 62 through the air ducting system 53 and transfer heat from components of the electronic motor power package 64 and the electric motor 52, and particularly its stator windings 67, to the flowing compressed air. The compressed air then travels in a generally axial direction through the rear of the second external housing portion 62 to the input 59 of the second compressor wheel 66. The second external housing portion 62 cooperates at its rear with the second compressor wheel 66 to provide a flow of compressed air from its periphery. The third external housing portion 63 directs the compressed air from the periphery of second compressor wheel 66 in a generally radially inward direction through a second plurality of straightening vanes 80 before sending the compressed air through compressor outlet 82.

Thus, an external housing portion of a motor-driven compressor-electronic package assembly (e.g., 34, 62, referring to FIGS. 3 and 6) can be formed to provide heat sinks to which the temperature sensitive semiconductor components can be directly attached or can provide a heat transfer mounting surface (e.g. 34*a*, 62*a*) for a pre-assembled electronic package. The external housing (e.g. 20, 65) is preferably formed to provide heat conductive paths with minimal thermal resistance leading to passageway surfaces cooled by forced convection with the flow of compressed air. The external motor housing (e.g. 34, 62) and motor support portion (e.g. 18, 78) are preferably formed by a single casting with a plurality of axial compressed air passageways (e.g. 35, 53) formed by cooling fins extending between the motor support (e.g. 18, 78) and an external housing portion (e.g. 34, 62) which carries the electronic package (e.g. 22, 64) so the flow of compressed air through the housing portion (e.g. 34, 62) and plurality of axial compressed air passageways extracts and carries away heat from both the electric motor and the temperature sensitive components of the electronic package. Thus, in preferred embodiments of the invention, components of both the electric motor and the electronic motor power package can be placed in heat transfer relationship with the flow of compressed air from the compressor.

While we have illustrated and described several embodiments of the invention that we believe comprise the best mode of the invention currently known, those skilled in the art will recognize that the invention can be incorporated into other embodiments and should be defined only by the claims that follow.

We claim:

1. A motor-driven compressor-electronic power package assembly, comprising an electric motor and a rotating shaft driven thereby, a compressor wheel driven by said rotating shaft, a central motor housing having an outside wall, and carrying a bearing system for the motor-driven rotating shaft, an external housing having an inside wall and an outside wall, the external housing comprising a first portion cooperating with the compressor wheel to generate a flow of compressed air, and a second portion carrying the central motor housing and forming, with its inside wall, an air ducting system with a plurality of straightening and cooling fins, an electronic power package for the electric motor carried by said second external housing portion, and said compressor wheel and second external housing portion providing a generally axial flow of compressed air through the air ducting system before exiting said motor-driven compressor through a compressed air outlet and drawing heat from the electric motor and the electronic power package.

2. The motor-driven compressor-electronic power package assembly of claim 1 wherein said electronic power package is attached to the outside wall of said second external housing portion, the attachment of said electronic power package permitting the conduction of heat from the electronic power package to the inside wall of the second external housing portion.

3. The motor-driven compressor-electronic power package assembly of claim 2 further comprising an air-tight enclosure for said electronic power package and a means for directing a stream of compressed cooling air from said external housing portion through said enclosure.

4. The motor-driven compressor-electronic power package assembly of claim 3 wherein said directing means comprises at least one compressed air inlet aperture through said external housing adjacent the periphery of the centrifugal compressor wheel, and at least one compressed air outlet aperture through said second housing portion, both of said apertures being located inside said air-tight enclosure.

5. The motor-driven compressor-electronic power package assembly of claim 1 wherein said air ducting system comprises means for directing the compressed air from said first external housing portion in a generally radially inward direction between a plurality of straightening vanes, and then in a generally axial direction between a plurality of cooling fins.

6. The motor-driven compressor-electronic power package assembly of claim 5 wherein said plurality of straightening vanes extends in a generally radial direction and alters the flow of compressed air from generally tangential flow to generally axial flow around the central motor housing for cooling purposes.

7. The motor-driven compressor-electronic power package assembly of claim 6 wherein said plurality of straightening vanes is formed by the inside wall of said second external housing portion.

8. The motor-driven compressor-electronic power package assembly of claim 7 wherein said plurality of straightening vanes is in heat transfer relationship with the electronic power package.

9. The motor-driven compressor-electronic power package assembly of claim 5 wherein said plurality of cooling fins extends in a generally radial direction from the outside wall of the central motor housing to the inside wall of said second external housing portion.

10. The motor-driven compressor-electronic power package assembly of claim 9 wherein said plurality of cooling fins transfers heat from said electric motor and said electronic power package to the flow of compressed air.

11. The motor-driven compressor-electronic power package assembly of claim 1 wherein said central motor housing substantially encloses and carries stator windings for said electric motor, the central motor housing being manufactured of a metallic material capable of transferring heat from the stator windings to said plurality of cooling fins.

12. A self-cooling, axial flow, permanent magnet motor-driven compressor-electronic package assembly, comprising a permanent magnet motor comprising a motor enclosure including a cylindrical housing and end closures, stator windings carried by the cylindrical housing, a pair of bearings carried by the end enclosures, and a permanent magnet rotor and motor shaft rotatably carried by the pair of bearings, said motor shaft having a portion extending outwardly through one of said end closures;

a centrifugal compressor wheel carried by said motor shaft portion, said compressor wheel having a plurality of air compressing vanes, said air compressing vanes having central air intake portions and peripheral compressed air output portions;

an external housing having a first portion forming an axial air inlet to the central air intake portions of the compressor wheel vanes, a second portion forming, with said one of the motor end closures, an outwardly extending annular compressed air passageway leading from the peripheral portions of the compressor wheel vanes, a third portion forming, with said one of the motor enclosures, an inwardly extending annular compressed air passageway leading from the outwardly extending compressed air passageway, and a fourth portion forming, with the cylindrical housing an axially extending annular compressed air passageway around the cylindrical motor housing and leading to an axially directed compressed air outlet, each of said inwardly extending annular compressed air passageway and said axially extending annular compressed air passageway including a plurality of vanes in their compressed air passageways; and an electronic package for application of polyphase alternating current to the stator windings, said electronic package being carried by said third and fourth portions of said external housing for transfer of heat from the electronic package to the compressed air flowing through external housing.

13. The motor-driven compressor-electronic package assembly of claim 12 wherein said vanes are formed by the interior of said third and fourth portions of the external housing, said vanes formed by said fourth external housing portion providing a low loss heat transferring interface with said cylindrical motor housing.

14. The motor-driven compressor-electronic package assembly of claim 12, further comprising an enclosure carried by said external housing and over said third and fourth portions of said external housing and said electronic package, and wherein said third portion of said external housing includes an inlet opening to admit a flow of compressed air between the enclosure and the external housing and said fourth portion of the external housing includes an outlet opening for the flow of compressed air from between said enclosure and said external housing to the compressed air outlet, said flow of compressed air between said inlet opening and said outlet opening providing further cooling for the electronics package.

15. The motor-driven compressor-electronic package assembly of claim 14 further comprising a conduit between the first portion of the external housing and the enclosure forming a bypass for and around the compressor wheel, and wherein the outlet opening is provided with a pressure actuated valve.

16. The motor-driven compressor-electronic package assembly of claim 12 wherein said motor shaft has a second portion extending outwardly through the compressor air outlet, a second centrifugal compressor wheel is carried by said second motor shaft portion, said second compressor wheel having a plurality of air compressing vanes with central air intake portions and peripheral compressed air output portions, and a backing plate is provided adjacent said second compressor wheel and, wherein said external housing includes a fifth portion forming an axial air inlet for the central air intake portion of said second compressor wheel, a sixth portion forming, with said backing plate, a second outwardly extending annular compressed air passageway leading from the peripheral compressed air output portions of the air compressing vanes of the second compressor wheel, and a seventh portion forming with said backing plate, a second inwardly extending annular compressed air passageway leading from said outwardly extending annular compressed air passageway to an axial output.

17. The motor-driven compressor-electronic package assembly of claim 16 wherein a plurality of vanes is provided between said seventh portion of the external housing and said backing plate to straighten the compressed air flow from the second compressor wheel.

18. An assembly including an electronic polyphase motor power package and a motor-driven air compressor formed about a central axis, comprising a compressor housing;

an electric motor comprising stator windings, a rotor and a rotatable shaft driven by said stator windings, said electric motor being carried within the compressor housing by a motor support carrying the stator windings and rotatably carrying said rotatable shaft on the central axis of the compressor;

a centrifugal compressor wheel carried by said rotating shaft of the motor on the central axis of the compressor;

said compressor housing having a first portion forming, with said compressor wheel, a compressed air passageway said air compressor providing an output of compressed air at its periphery, and a second portion forming a compressed air passageway from the periphery of the compressor wheel, said second portion of the compressor housing carrying said polyphase electronic motor power package and directing a flow of compressed air into a heat transfer relationship with said polyphase electronic motor power package and said motor support.

19. The assembly of claim 18 wherein a second centrifugal compressor wheel is carried by the rotating shaft within the compressor housing on the central axis of the compressor, and wherein the compressor housing directs the flow of compressed air from the motor support to the second compressor wheel and forms, with a compressor wheel backing plate, a further compressed air passageway from said second compressor wheel to a compressed air outlet located on the central axis.

20. The assembly of claim 18 wherein the second portion of the compressor housing forms a heat sink for components of the polyphase electronic motor power package and cooling fins in the compressed air passageway extending between the second external housing portion and motor support.

21. The assembly of claim 18 wherein said second portion forms an inwardly extending annular compressed air passageway leading from the periphery of the compressor wheel to adjacent the motor support and an axially extending annular compressed air passageway between said second external housing portion and said motor support, said inwardly extending compressed air passageway including a first plurality of compressed air flow straightening fins and said axially extending annular compressed air passageway including a second plurality of compressed air cooling fins, said polyphase electronic motor power package being carried by said second external housing portion contiguously with said inwardly extending annular passageway and said axially extending annular passageway.

22. The assembly of claim 18 further comprising an enclosure carried by said compressor housing over said second housing portion, said second external housing portion including a compressed air inlet and a compressed air outlet for directing a cooling flow of compressed air between said enclosure and said second external housing portion and over said polyphase electronic motor power package.

23. An electric motor power package and motor-driver compressor assembly, comprising an external housing;

an electric motor comprising stator windings, a rotor and rotatable shaft driven by said stator windings, said electric motor being carried within said external housing in a motor support carrying the stator windings and rotatably carrying said rotatable shaft, compressor wheel carried by said rotatable shaft within said external housing and cooperating therewith to provide a flow of compressed air from its periphery, said external housing carrying said electronic motor power package downstream of said compressor wheel and forming a compressed air passageway in heat transfer relationship with said electronic motor power package and said electric motor, and further forming, with an enclosure for said electronics power package, a further compressed air passageway over said electronic motor power package.

24. A motor-driven two-compressor assembly, comprising a high-speed, permanent magnet electric motor comprising stator windings, and a permanent magnet rotor and a rotating shaft carried by a pair of shaft bearings and driven by said stator windings about an axis of rotation, said rotatable shaft including shaft extensions extending outwardly from both of the shaft bearings;

a central motor housing enclosing the electric motor and carrying said stator windings between said pair of shaft bearings for the motor-driven rotating shaft;

first and second centrifugal compressor wheels attached to said shaft extensions, each compressor wheel comprising a wall extending outwardly from a shaft-engaging hub carrying a plurality of compressor vanes;

an external housing with three portions, the first and third portions of said external housing each forming a compressor casing, each compressor casing enclosing and cooperating with one of the compressor wheels and forming a central air inlet and a compressed air outlet; the second portion of said external housing carrying the central motor housing and forming an air ducting system around the central motor housing;

said compressor wheels and said second portion of the external housing providing a generally axial flow of compressed air through the air ducting system before entering the third external housing portion, thereby drawing heat from the central motor housing.

25. The motor-driven two-compressor assembly of claim 24 wherein said second external housing portion carries an electronic motor power package for operating said electric motor, said second external housing portion providing conduction of heat from components of the electronic motor power package to the air ducting system.

26. The motor-driven two-compressor electronic motor power package assembly of claim 25 further comprising an air-tight enclosure for said electronic motor power package and means for directing a stream of compressed cooling air from said first external housing portion through said enclosure.

27. The motor-driven two-compressor electronic motor power package assembly of claim 26 wherein said directing means comprises at least one air inlet aperture through said first housing portion adjacent the periphery of the centrifugal compressor wheel, and at least one air outlet aperture through said second housing portion, both apertures being located within said air-tight enclosure.

28. The motor-driven two-compressor electronic motor power package assembly of claim 25 wherein said second external housing portion forms an air ducting system with an annular compressed air passageway directing the compressed air from the periphery of the first compressor wheel in a generally radially inward direction through a plurality of compressed air straightening vanes, and provides heat transfer from components of the electronic motor power package to compressed air flowing therethrough.

29. The motor-driven two-compressor electronic motor power package assembly of claim 28 wherein said plurality of straightening vanes extend in a generally radial direction between a backing plate for the first compressor wheel and an inside wall of said second external housing portion.

30. The motor-driven two-compressor electronic motor power package assembly of claim 29 wherein said plurality of straightening vanes are curved and alter the flow of air within the second external housing portion from a generally tangential flow to a generally axial flow around the central motor housing for cooling.

31. The motor-driven two-compressor assembly of claim 24 wherein said air ducting system includes a plurality of cooling fins extending between said central motor housing and said second external housing portion, and forming a plurality of axial compressed air passageways therebetween, and providing for heat transfer from the electric motor to compressed air flowing therethrough.

32. The motor-driven two-compressor assembly of claim 31 wherein said second external housing portion carries an electronic motor power package and forms an annular compressed air passageway leading from the periphery of the first compressor wheel in a radially inward direction through a plurality of curved flow-straightening vanes to said plurality of axial compressed air passageways, said second external housing portion and plurality of curved flow-straightening vanes being in heat transfer relationship with components of the electronic motor power package.

* * * * *